US007268733B2

(12) United States Patent
Tsurume et al.

(10) Patent No.: US 7,268,733 B2
(45) Date of Patent: Sep. 11, 2007

(54) HIGH FREQUENCY GLASS ANTENNA FOR AUTOMOBILES

(75) Inventors: Yoshinobu Tsurume, Tokyo (JP); Hitoshi Kakizawa, Tokyo (JP)

(73) Assignee: Nippon Sheet Glass Company, Limited, Tokyo (JP)

( * ) Notice: Subject to any disclaimer, the term of this patent is extended or adjusted under 35 U.S.C. 154(b) by 0 days.

(21) Appl. No.: 11/106,127

(22) Filed: Apr. 14, 2005

(65) Prior Publication Data

US 2005/0231432 A1 Oct. 20, 2005

(30) Foreign Application Priority Data

Apr. 16, 2004 (JP) ..... 2004-121144

(51) Int. Cl.
*H01Q 1/32* (2006.01)

(52) U.S. Cl. ..... 343/713; 343/713; 343/700 MS

(58) Field of Classification Search ..... 343/713, 343/700 MS
See application file for complete search history.

(56) References Cited

U.S. PATENT DOCUMENTS 5,198,826 A * 3/1993 Ito ..... 343/726
5,497,167 A 3/1996 Luoma
5,898,407 A 4/1999 Paulus et al.
6,002,373 A * 12/1999 Taniguchi et al. ..... 343/713
6,008,766 A * 12/1999 Maeda et al. ..... 343/713

* cited by examiner

*Primary Examiner*—Thuy V. Tran
*Assistant Examiner*—Dieu Hien T Duong
(74) *Attorney, Agent, or Firm*—RatnerPrestia

(57) ABSTRACT

A high frequency and broad band glass antenna for automobiles has a strong directivity in one direction even if the antenna is provided near to the mental portion of a body. The antenna comprises an antenna line provided near to the metal portion of a body, one end of the antenna line neighboring the metal portion being fed; and a parasitic line positioned near to the antenna line for adjusting a directivity and a frequency characteristic of reception sensitivity of the glass antenna. The antenna line consists of a straight antenna line has the length (λ/4)κ. The parasitic line extends in parallel with the antenna line and consists of at least one straight conductor line having the length of (λ/8)κ. The length that the conductor line overlaps with the antenna line is (λ/8)κ. The distance between the conductor line and the antenna line is (λ/64)κ.

6 Claims, 10 Drawing Sheets

HIGH FREQUENCY GLASS ANTENNA FOR AUTOMOBILES

BACKGROUND OF THE INVENTION

1. Field of the Invention

The present invention relates to a high frequency glass antenna for automobiles, particularly to a high frequency glass antenna for automobiles used for transmitting/receiving an electric wave of a band more than UHF band (300 MHz or more).

2. Related Art

As a high frequency glass antenna for automobiles used for transmitting/receiving an electric wave of a high frequency band such as 300 MHz or more, there have been provided high frequency glass antennas suitable for an automobile communication means utilizing a GPS space satellite signal (1.575.42 MHz), a TV broadcasting wave (471-771 MHz), 800 MHz band (810-960 MHz), or 1.5 GHz band (1.429~1.501 GHz) for automobile telephones, for example.

In these high frequency glass antennas for automobiles, a directivity is required, because if a glass antenna receives electric waves coming from various directions, then a ghost is generated due to the phase difference among the received waves.

When such a glass antenna is provided on a front window or rear window of an automobile, the antenna is to be provided at the region near to the metal portion of a body, because a view field of a driver must be maintained for the front window and heating lines are formed on the rear window.

Japanese Patent Publication number 2002-135025 discloses the receiving system utilizing a YAGI antenna (comprising a director and reflector) showing a strong directivity for one direction as a glass antenna having less effect to a multi-path when a running automobile receives an electric wave.

The high frequency glass antenna for automobiles disclosed in above-described Japanese Patent Publication utilizes the metal portion of a body as a reflector, so that the directivity of the glass antenna is decided by the position of the metal portion. This causes a problem such that the freedom of a design for a directivity is disturbed. For example, in the case that an antenna element is positioned horizontally near to the roof of a body on an inclined front window or rear window, the antenna has a directivity in an inclined direction of the window, i.e., a downward direction. This means that the antenna has no effective directivity in a horizontal direction or elevation direction which is the direction of a coming broadcasting wave.

SUMMARY OF THE INVENTION

An object of the present invention, therefore, is to provide a high frequency and broad band glass antenna for automobiles which has a strong directivity in one direction without having an effect of the metal portion of a body even if the antenna is positioned near to the metal portion of a body.

In the high frequency glass antenna for automobiles in accordance with the present invention, an antenna pattern is designed on the basis of a parasitic-type of antenna (which consists of an antenna line connected to a feeding point and a parasitic antenna insulated from the feeding point and having first and second ends which are not connected) that typically is YAGI antenna among beam antennas having a directivity in one direction. In such a parasitic-type antenna, a directivity may be determined by adjusting the phase difference between a standing wave induced on the antenna line and a standing wave induced on the parasitic line.

The present invention is based on the recognition that an intended direction of beam may be realized without having an effect of the metal portion of a body of an automobile even if a glass antenna is provided near to the metal portion by varying a pattern and a position of a parasitic line arranged at the distance of the range of $(\lambda/84)\kappa$-$(\lambda/16)\kappa$ from the antenna line connected to a feeding point.

In general, an antenna line connected to a feeding point has resonance points at only one frequency and frequencies integrally multiplied by said one frequency. However, the glass antenna according to the present invention may receive a broad band frequency with a better sensitivity by capacitively coupling a parasitic line designed to have a resonance point different from that of an antenna line to the antenna line.

In accordance with the present invention, a glass antenna provided on the surface of a window of automobiles for transmitting/receiving a high frequency electric wave comprises an antenna line positioned near to the metal portion of a body, one end of the antenna line neighbored to the metal portion being fed; and a parasitic line positioned near to the antenna line for adjusting a directivity and a frequency characteristic of reception sensitivity of the glass antenna.

The antenna line is connected to a feeding point and has the length of $(\lambda/4)\kappa$, wherein $\lambda$ is a wavelength of a received wave in a high frequency band and $\kappa$ is a shortening factor. It is noted that the antenna line is composed of at least one straight antenna line.

On the other hand, the parasitic line may be structured as follows:

(1) The parasitic line is extended in parallel with the antenna line and consists of at least one straight conductor lines having the length in the range of $(\lambda/4)\kappa$-$(\lambda/2)\kappa$, the length of each of the straight conductor lines being overlapped with the antenna line is in the range of $(\lambda/16)\kappa$-$(\lambda/8)\kappa$, and the distance between each of the straight conductor lines and the antenna line is in the range $(\lambda/84)\kappa$-$(\lambda/16)\kappa$, (2) The parasitic line consists of two straight conductor lines extending in parallel with the antenna line and sandwiching a part thereof, the length of each of the two conductor lines being $(3\lambda/16)\kappa$, and a conductor line for connecting respective ends of the two straight conductor lines, far from the feeding point, the length of the part of respective straight conductor lines overlapped with the antenna line is $(\lambda/8)\kappa$, and the distance between each of the two straight conductor lines and the antenna line is $(\lambda/64)\kappa$.

(3) The parasitic line consists of a straight conductor line positioned on the portion extended from the antenna line in a direction opposite to the feeding point, the length of the parasitic line being $(\lambda/4)\kappa$.

The antenna line may be a loop-shaped antenna line. In this case, the parasitic line consists of at least one straight conductor line extended in parallel with the loop-shaped antenna.

BEST MODE FOR CARRYING OUT THE INVENTION

Embodiments in accordance with the present invention will now be described with reference to the accompanying drawings.

EMBODIMEBT 1

Figure 1:
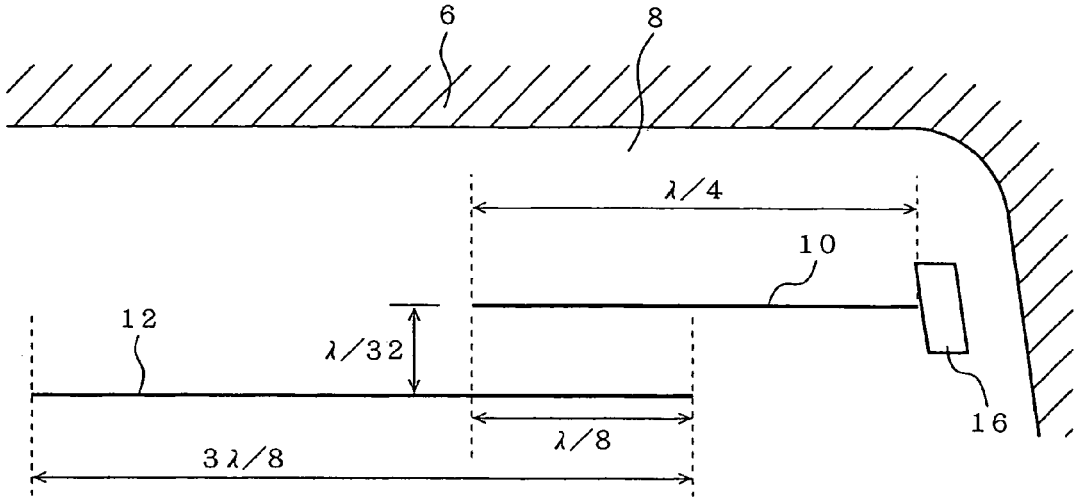
FIG. 1 shows an antenna pattern of a high frequency glass antenna of an embodiment 1.

FIG. 1 shows an antenna pattern of a high frequency glass antenna of an embodiment 1. The glass antenna is provided on a front window 8 surrounded by a body 6. As shown in the figure, the antenna is provided on the upper right portion of the front window 8 near to the metal portion 6 (the roof) of a body in order not to disturb a view field of a driver. The front window is inclined at an angle of 30°-40° with respect to a vertical direction. The antenna is composed of a combination of a straight antenna line (a feeding line) 10 of a $\lambda/4$ monopole type or the like and one straight conductor line (a parasitic line) 12. The parasitic line 12 is extended in parallel with the feeding line 10 and is partly overlapped with the feeding line 10, the line 12 being not coupled in DC (direct current) to the line 10. Reference numeral 16 shows a feeding point to which one end of the feeding line 10 is connected.

It is noted that $\lambda$ is a wavelength of a received electric wave and $\kappa$ is a shortening factor. The shortening factor relates to a propagation rate of a wave propagating through a dielectric substrate (a glass plate in this case), and is a ratio of the size of an antenna formed on the dielectric substrate to be resonated with respect to the size of an antenna provided in a space to be resonated. $\kappa$ is omitted in the figure for a simplicity of the drawing.

The length of the feeding line 10 is $(\lambda/4)\kappa$. The parasitic line 12 is overlapped with the feeding line 10 across the length $(\lambda/8)\kappa$ which is a half of the length of the feeding line 10. The length of non-overlapped portion of the line 12 is $(\lambda/4)\kappa$. The total length of the parasitic line 12 is, therefore, $(3\lambda/8)\kappa$.

The parasitic line 12 is positioned at the distance of $(\lambda/32)\kappa$ from the feeding line 10. In this manner, the parasitic line 12 is positioned near to the feeding line 10 to adjust a directivity and a frequency characteristic of reception sensitivity.

According to the present embodiment, an antenna may be implemented, in which a directivity and a stable reception performance in a broad band is realized by combining the feeding line 10 and parasitic line 12.

As an example, concrete sizes will now be studied for the case that a resonance frequency is 600 MHz. $\lambda$ is 50 cm for this case. Assuming that a shortening factor is 0.65, the length of the feeding line 10 is $(50/4)\times0.65=8.1$ cm, the length of the parasitic line 12 is $(3\times50/8)\times0.65=12.2$ cm, and the distance between the lines 10 and 12 is $(50/32)\times0.65=1.0$ cm. It is appreciated from these sizes that the area occupied by the glass antenna is small.

Figure 2:
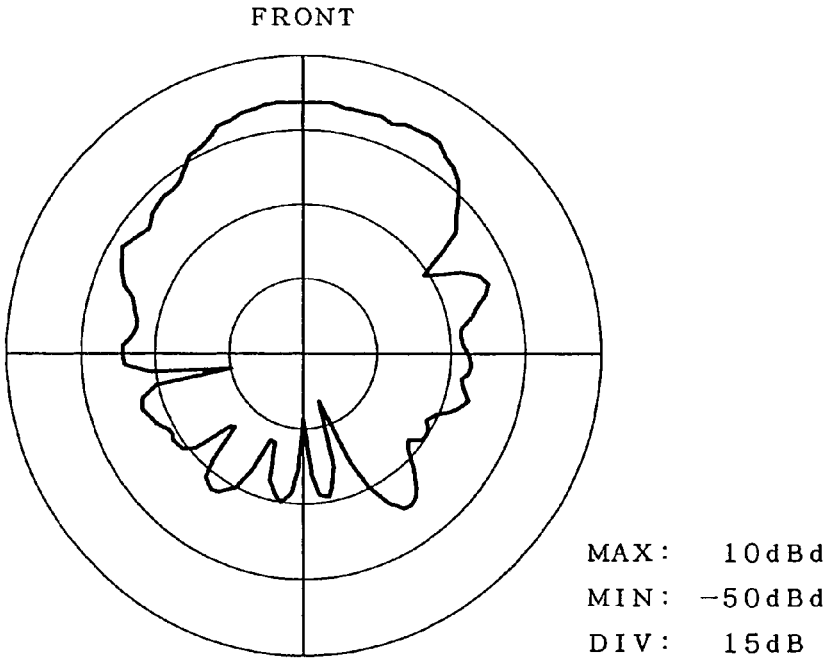
FIG. 2 shows a directivity of the antenna in the embodiment 1.

A directivity in a horizontal plane of this glass antenna was measured. The directivity shown in FIG. 2 was obtained. It is appreciated that the strong directivity in a forward direction of an automobile was realized.

Figure 3:
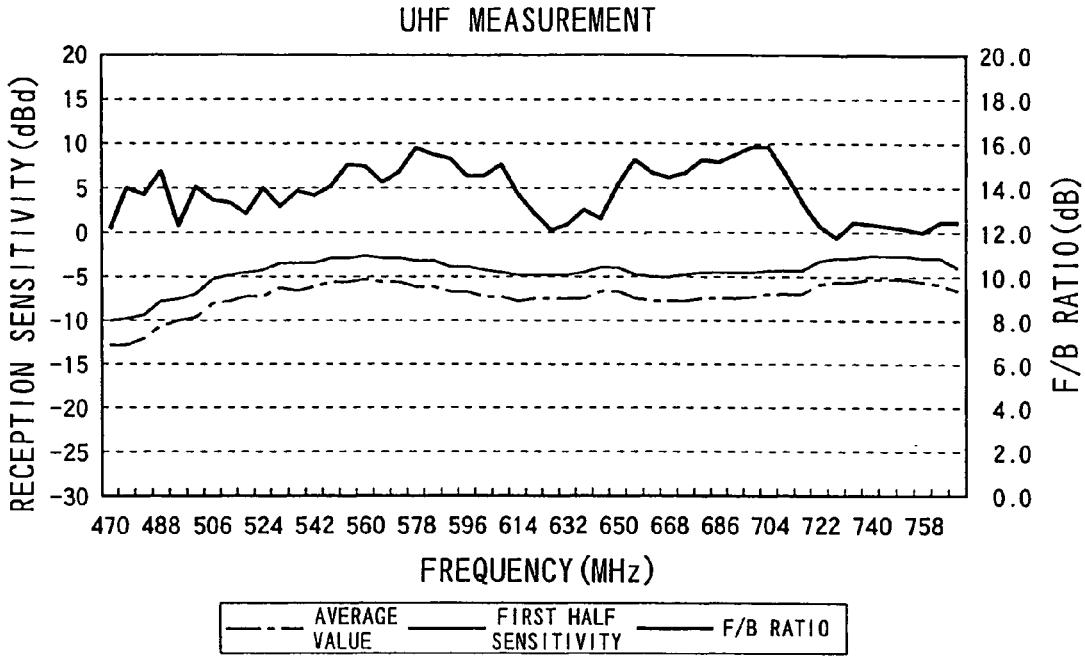
FIG. 3 shows a reception sensitivity (F/B ratio) of the antenna in the embodiment 1.

Also, the frequency characteristic of F/B (Front/Back) ratio was determined. The characteristic shown in FIG. 3 was obtained. Herein, the F/B ratio is a difference between a directive gain in a frontward direction (i.e., a direction in which a beam is radiated from the antenna) and a directive gain in a backward direction, and is a estimation factor for an antenna directive gain (a beam strength). If the value of the F/B ratio is small, the directivity has the small difference between the frontward directive gain the backward directive gain, resulting in a rounded directivity characteristic. On the other hand, if the value of the F/B ratio is large, the directivity has the large difference between the frontward directive gain and the backward directive gain, resulting in a characteristic having a strong directivity in a forward direction. The F/B ratio in FIG. 3 is represented by the ratio between the average directive gain for 180° range in a forward direction and the average directive gain for 180° range in a backward direction. For the calculation of the average gain, the method for calculating an a real average was applied. It is noted that the first half sensitivity corresponding to the average directive gain for 180° range in a forward direction described above and the average value are shown together in FIG. 3. It is appreciated from the F/B ratio in FIG. 3 that the antenna has a strong directivity in a forward direction.

Figure 4:
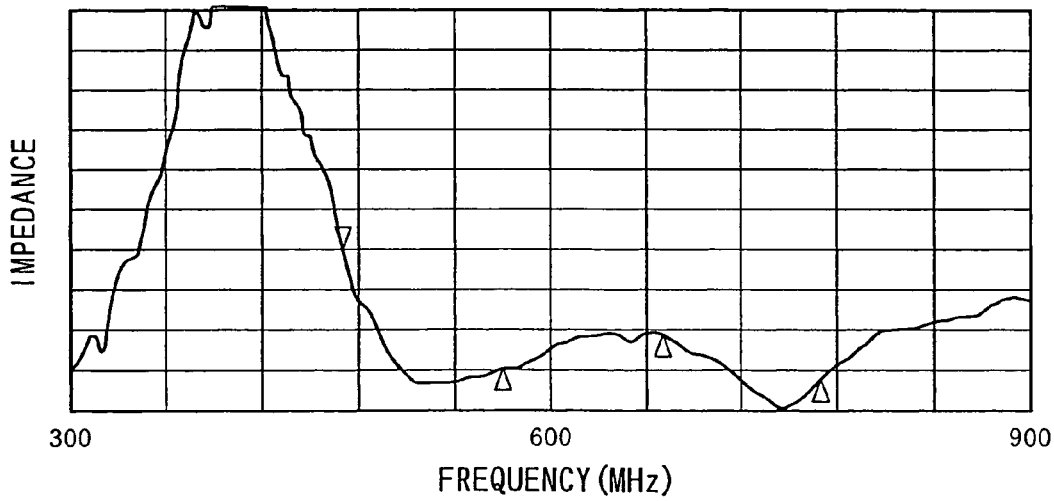
FIG. 4 shows an impedance of the antenna in the embodiment 1.

FIG. 4 shows the measured result of an antenna impedance in the range of 300 MHz-900 MHz. It is appreciated from the measured result that the antenna has stable resonance points (designated by the mark ∇) in a broad band.

Figure 5:
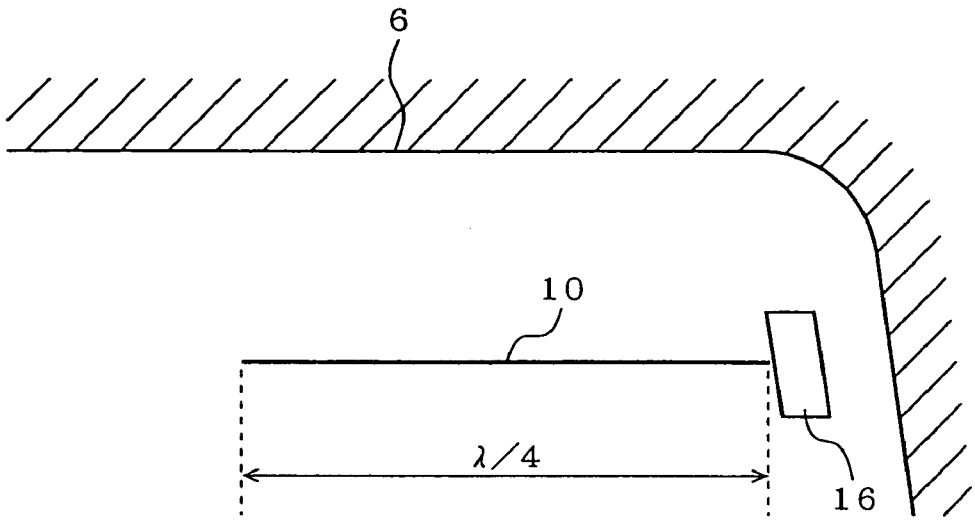
FIG. 5 shows a pattern of the antenna comprising only the feeding line.
Figure 6:
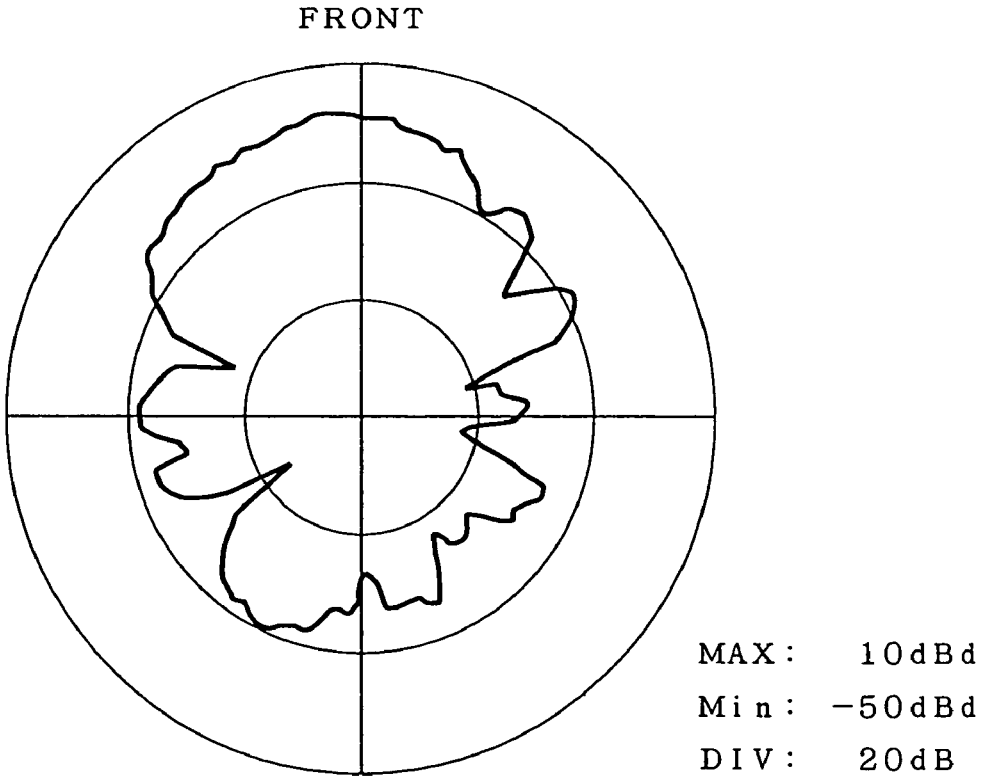
FIG. 6 shows a directivity of the antenna in FIG. 5.
Figure 7:
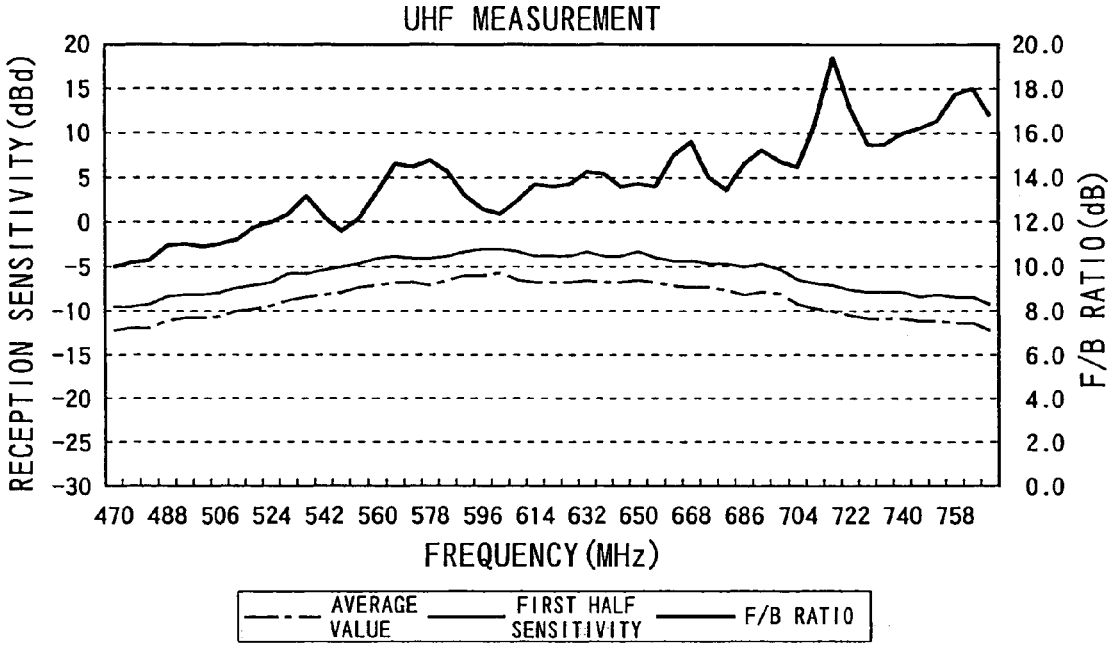
FIG. 7 shows a reception sensitivity (F/B ratio) of the antenna in FIG. 5.

FIG. 5 shows a glass antenna comprising only the feeding line 10 for comparison. The directivity of this glass antenna is shown in FIG. 6 and the frequency characteristic of the F/B ratio is shown in FIG. 7. FIGS. 6 and 7 correspond to that shown in FIGS. 2 and 3 in the present embodiment.

As clear from the comparison of these characteristics, it is appreciated that the antenna according to the present embodiment has a strong directivity in a forward direction through a broad band in comparison with the antenna in FIG. 5.

EMBODIMENT 2

Figure 8:
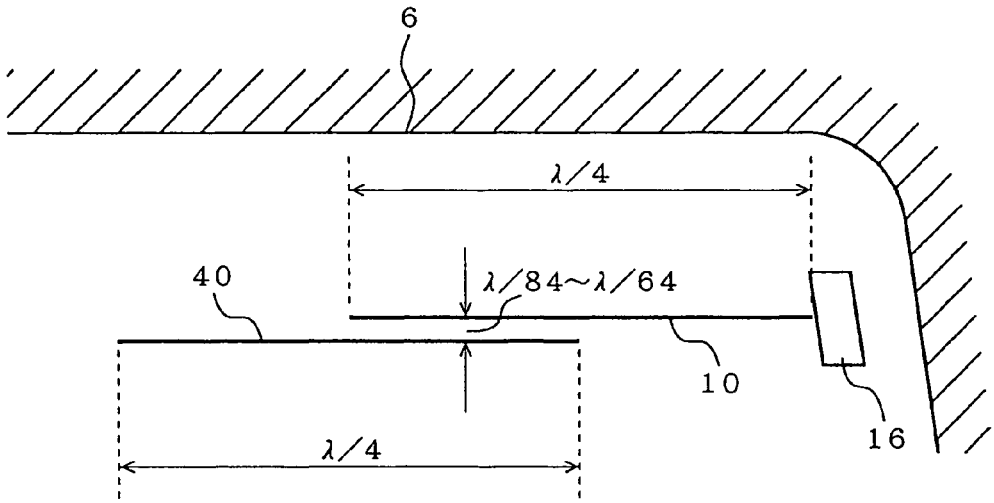
FIG. 8 shows an antenna pattern of a high frequency glass antenna of an embodiment 2.

FIG. 8 shows an antenna pattern of a high frequency glass antenna of an embodiment 2. This glass antenna has the same antenna pattern as in the embodiment 1 except that the sizes of them are different.

According to the present embodiment, a parasitic line 40 having the length of (λ/4)κ is positioned in parallel with a feeding line 10 of (λ/4) monopole type. The distance between the lines 10 and 40 is in the range of (λ/84)κ-(λ/64)κ.

Figure 9:
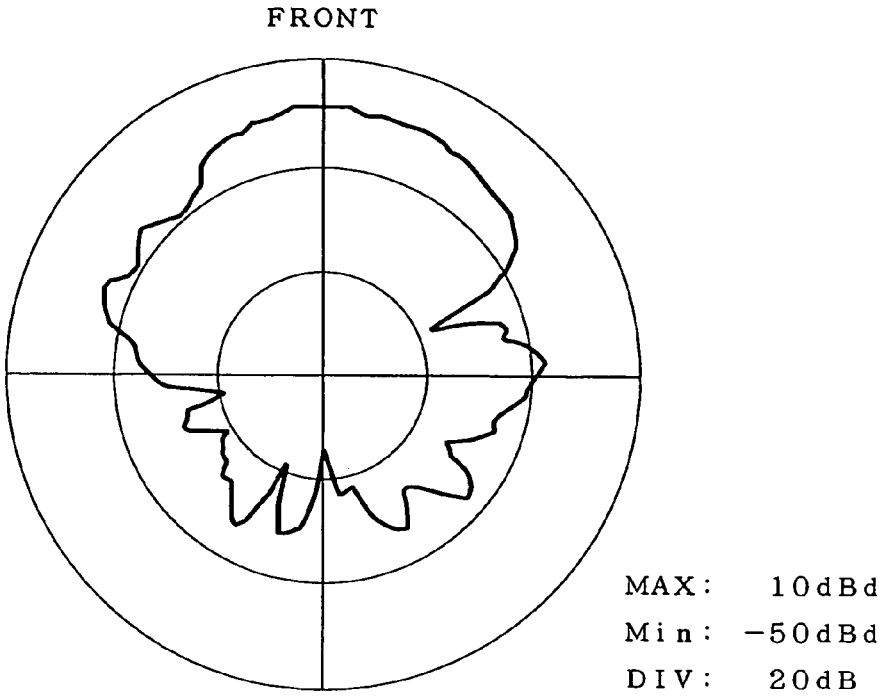
FIG. 9 shows a directivity of the antenna in the embodiment 2.

A directivity in a horizontal plane of this glass antenna was measured. The directivity shown in FIG. 9 was obtained. It is appreciated that the strong directivity in a forward direction of an automobile was realized.

EMBODIMENT 3

Figure 10:
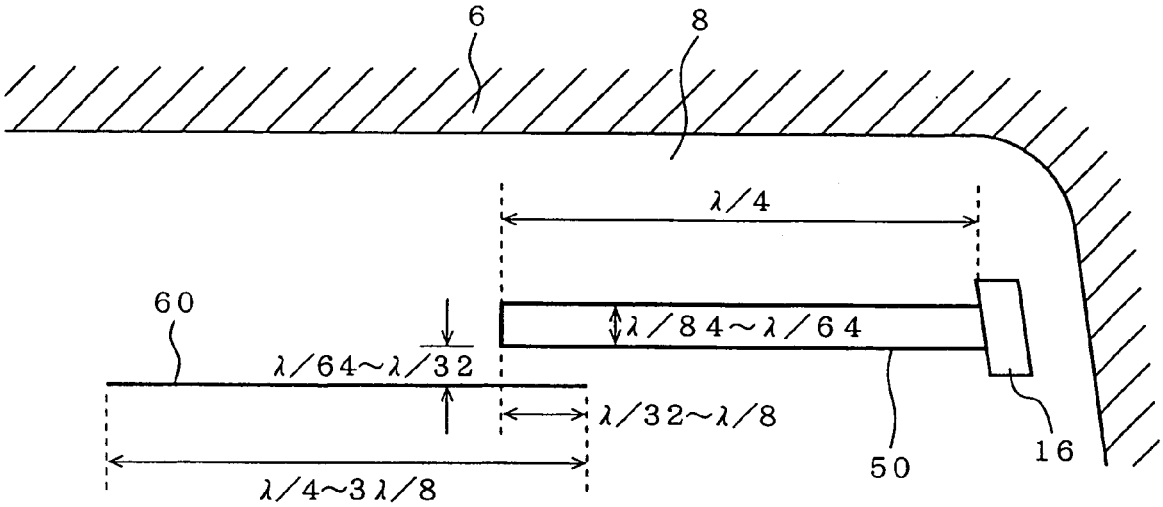
FIG. 10 shows an antenna pattern of a high frequency glass antenna of an embodiment 3.

FIG. 10 shows an antenna pattern of a high frequency glass antenna of an embodiment 3. While a feeding line is composed of one conductor line in the embodiments 1 and 2, a feeding line in the present embodiment 3 is composed of a loop-shaped feeding line 50. The loop-shaped feeding line 50 is formed by two straight conductor lines extended in parallel and fed by the common feeding point 16, each line having a length of (λ/4)κ and the distance between two conductor lines being (λ/84~λ/64)κ, and respective ends of the two conductor lines far from the feeding point 16 being connected each other.

A parasitic line 60 is positioned in parallel with the feeding line 50. The length of the parasitic line 60 is in the range of (λ/4)κ-(3λ/8)κ, and the length thereof overlapped with the square loop-shaped antenna 50 is in the range of (λ/32)κ-(λ/8)κ.

The distance between the loop-shaped line 50 and the parasitic line 60 is in the range of (λ/64)κ-(λ/32)κ.

Figure 11:
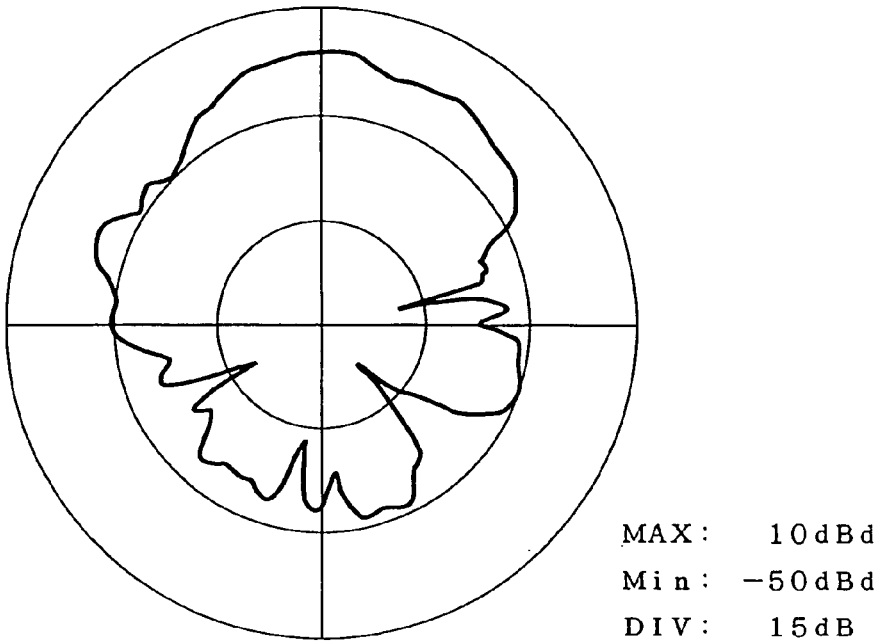
FIG. 11 shows a directivity of the antenna in the embodiment 3.

A directivity in a horizontal plane of this glass antenna was measured. The directivity shown in FIG. 11 was obtained. It is appreciated that the strong directivity in the forward direction of an automobile was realized.

Figure 12:
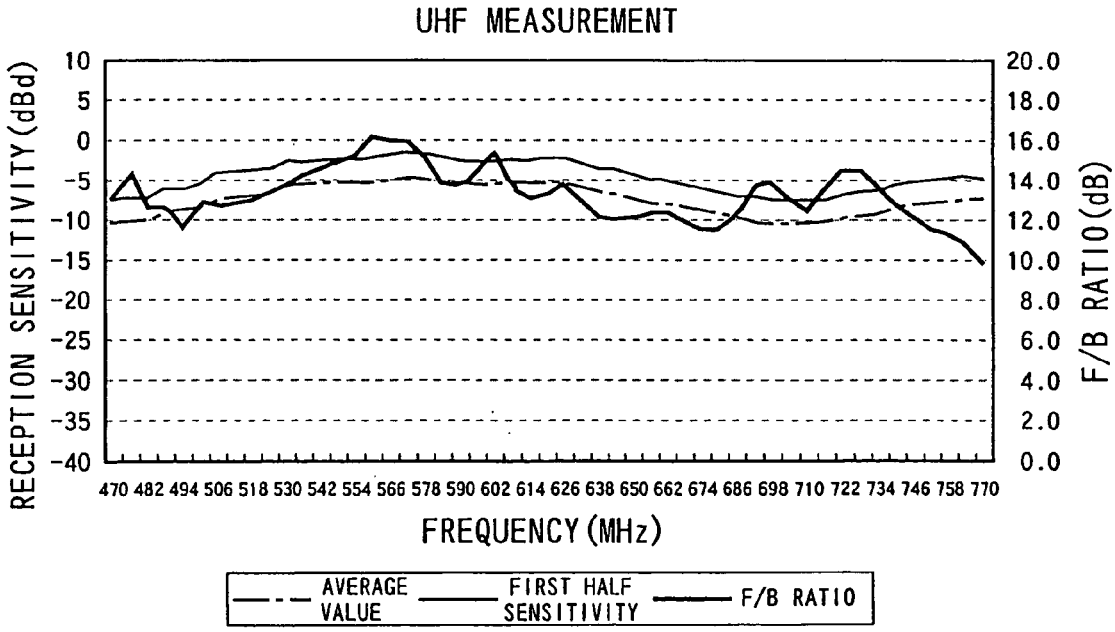
FIG. 12 shows a reception sensitivity (F/B ratio) of the antenna in the embodiment 3.

Also, the frequency characteristic of F/B ratio was determined. The characteristic shown in FIG. 12 was obtained. It is appreciated from the F/B ratio in FIG. 12 that the antenna has a strong directivity in a forward direction.

According to the glass antenna of the present embodiment, the directive gain was about 3 dB higher than that in the embodiments 1 and 2.

EMBODIMENT 4

Figure 13:
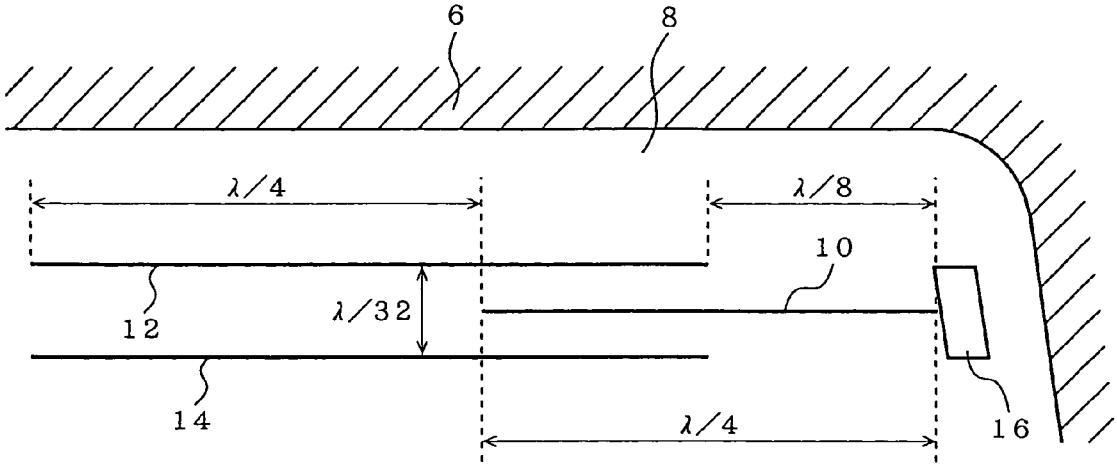
FIG. 13 shows an antenna pattern of a high frequency glass antenna of an embodiment 4.

FIG. 13 shows an antenna pattern of a high frequency glass antenna of an embodiment 4. This glass antenna is composed of a combination of a straight antenna line (a feeding line) 10 of a λ/4 monopole type or the like and two straight conductor lines (parasitic lines) 12 and 14 extended in parallel with the feeding line 10 and sandwiching a part of the feeding line 10, the lines 12 and 14 being not coupled in DC (direct current) to the line 10. Reference numeral 16 shows a feeding point to which one end of the feeding line 10 is connected.

The length of the feeding line 10 is (λ/4)κ. The parasitic lines 12 and 14 are overlapped with the feeding line 10 across the length (λ/8)κ which is a half of the length of the feeding line 10. The length of non-overlapped portion of each of the lines 12 and 14 is (λ/4)κ. Total length of each of the parasitic lines 12 and 14 is, therefore, (3λ/8)k.

Respective parasitic lines 12 and 14 are positioned at the distance of (λ/64)κ from the feeding line 10. The distance between the parasitic lines 12 and 14 is (λ/32)k.

The parasitic lines 12 and 14 are positioned near to the feeding line 10 as described above to adjust a directivity and a frequency characteristic of reception sensitivity. In this manner, a broad band antenna having a directivity may be realized by the combination of the feeding line 10 and parasitic lines 12, 14 to be resonated at a high frequency.

As an example, concrete sizes will now be studied for the case that a resonance frequency is 600 MHz. λ is 50 cm for this case. Assuming that a shortening factor is 0.65, the length of the feeding line 10 is (50/4)×0.65=8.1 cm, the length of respective parasitic lines 12 and 14 are (3×50/8)×0.65=12.2 cm, and the distance between the lines 12 and 14 is (50/32)×0.65=1.0 cm. It is from these sizes appreciated that the area occupied by the glass antenna is small.

Figure 14:
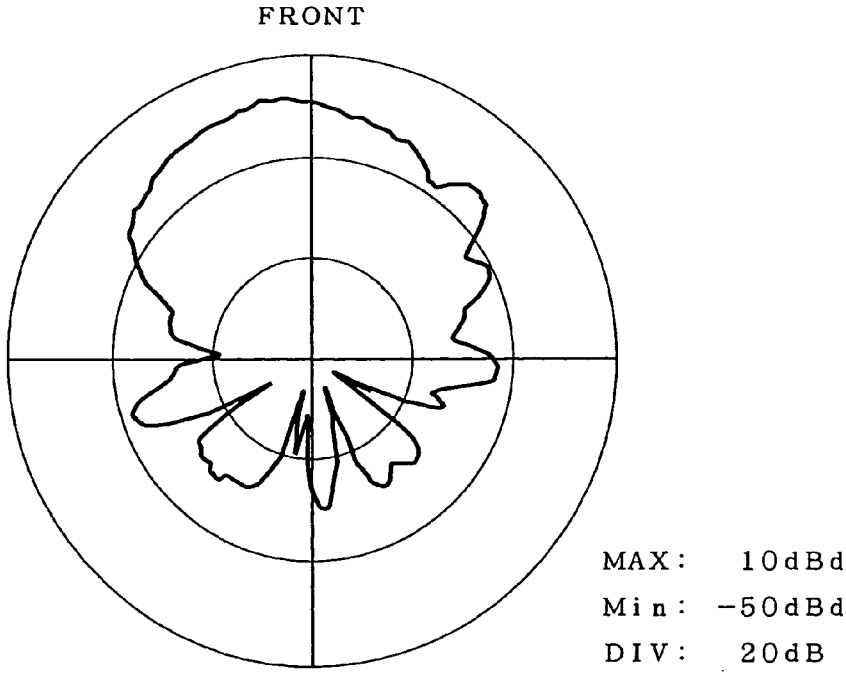
FIG. 14 shows a directivity of the antenna in the embodiment 4.
Figure 15:
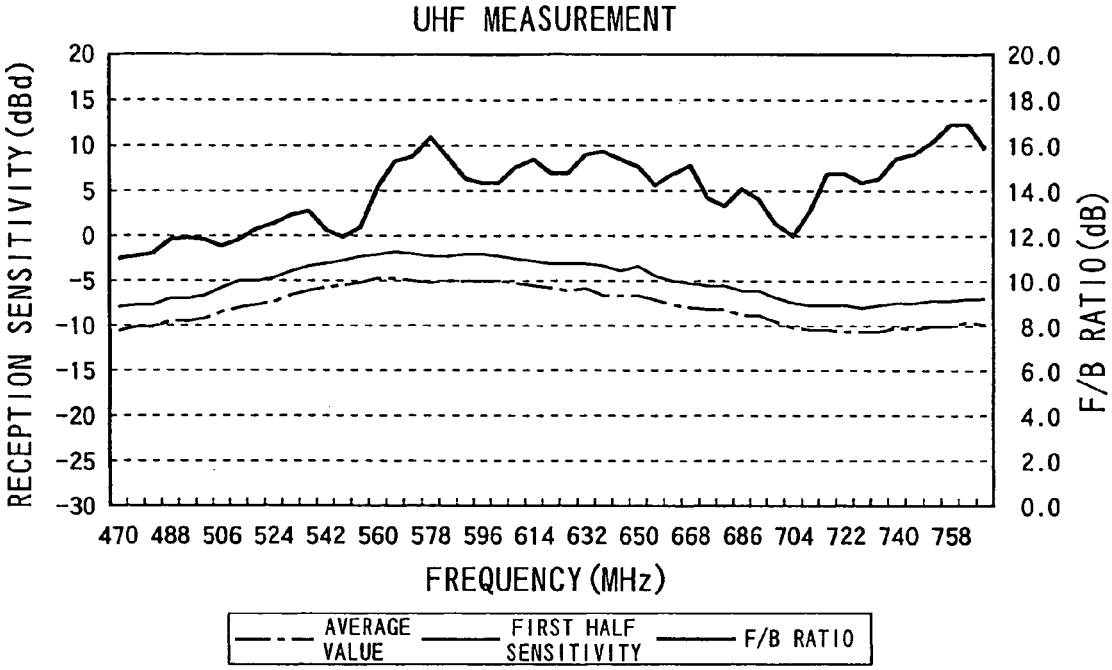
FIG. 15 shows a reception sensitivity (F/B ratio) of the antenna in the embodiment 4.

A directivity in a horizontal plane of this glass antenna was measured. The directivity shown in FIG. 14 was obtained. FIG. 15 shows a frequency characteristic of F/B ratio for an electric wave in the range of 470-770 MHz. It is appreciated from these characteristics that the strong directivity across a broad band in the forward direction of an automobile was realized.

EMBODIMENT 5

Figure 16:
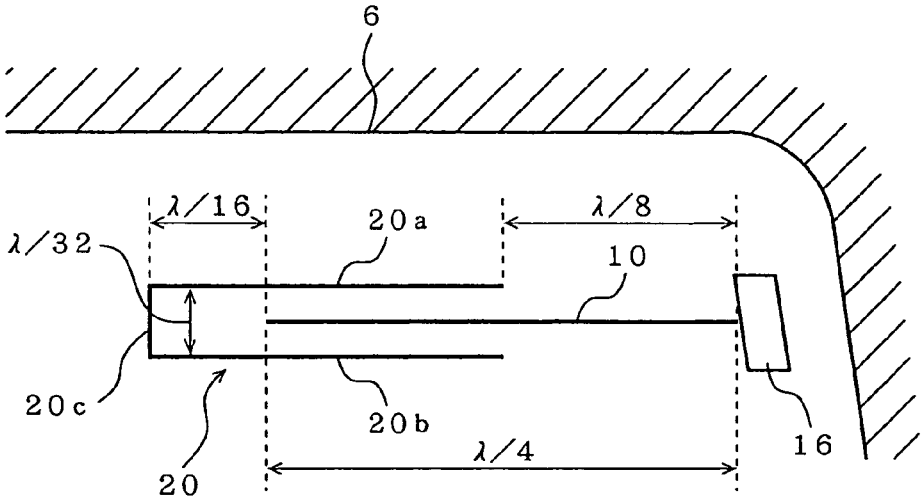
FIG. 16 shows an antenna pattern of a high frequency glass antenna of an embodiment 5.

FIG. 16 shows an antenna pattern of a high frequency glass antenna of an embodiment 5. This glass antenna has a pattern which is a modified pattern of the parasitic line of the glass antenna in FIG. 8. A parasitic line 20 consists of two conductor lines 20*a* and 20*b* are extended in parallel with the feeding line 10 and sandwiching a part of the feeding line 10, and a conductor line 20*c* which connects the right ends of the two conductor lines to each other.

The parasitic lines 20*a* and 20*b* are overlapped with the feeding line 10 across the length of (λ/8)κ. The length of non-overlapped portion of each of the parasitic lines is (λ/16)κ. Total length of each of the parasitic lines 20*a* and 20*b* is, therefore, (3λ/16)κ.

Respective parasitic lines 20*a* and 20*b* are positioned at the distance of (λ/64)κ from the feeding line 10. Therefore, the length of the parasitic line 20*c* is (λ/32)κ.

Figure 17:
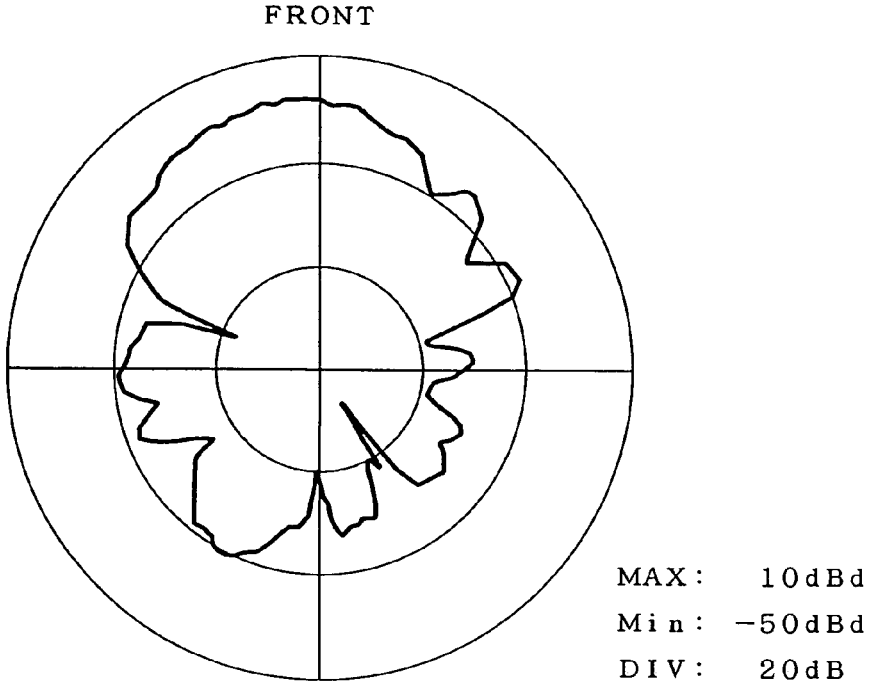
FIG. 17 shows a directivity of the antenna in the embodiment 5.
Figure 18:
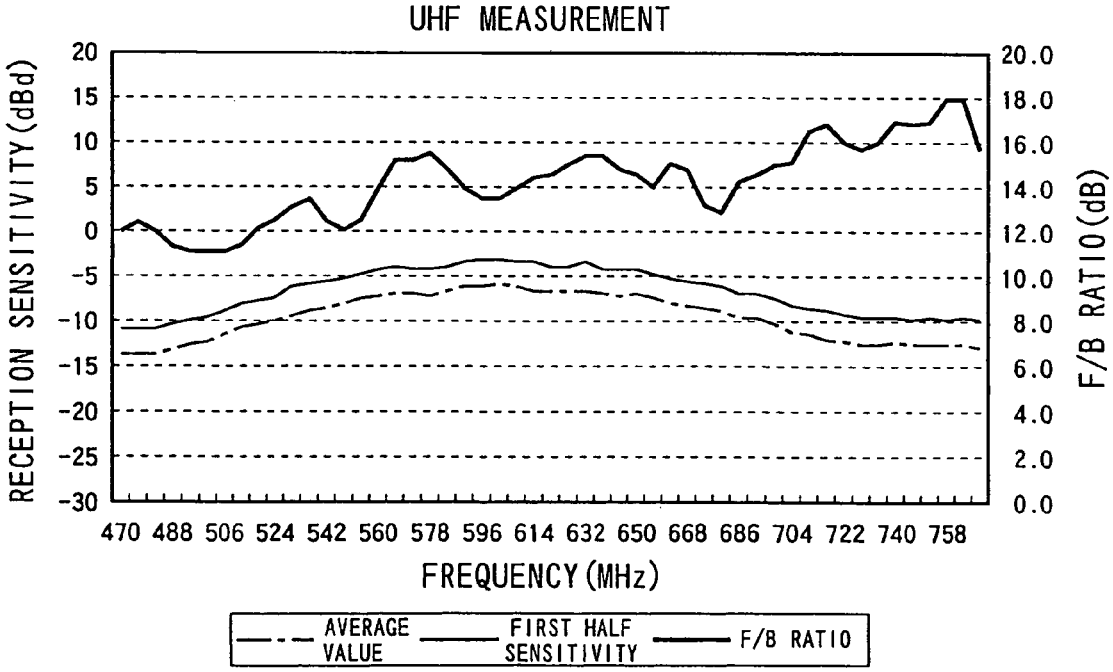
FIG. 18 shows a reception sensitivity (F/B ratio) of the antenna in the embodiment 5.

A directivity in a horizontal plane of this glass antenna was measured. The directivity shown in FIG. 17 was obtained. Also, a frequency characteristic of F/B ratio of this glass antenna was measured. FIG. 18 shows a measured frequency characteristic of F/B ratio. It is appreciated from these characteristics that the strong directivity across a broad band in the forward direction of an automobile was realized.

EMBODIMENT 6

Figure 19:
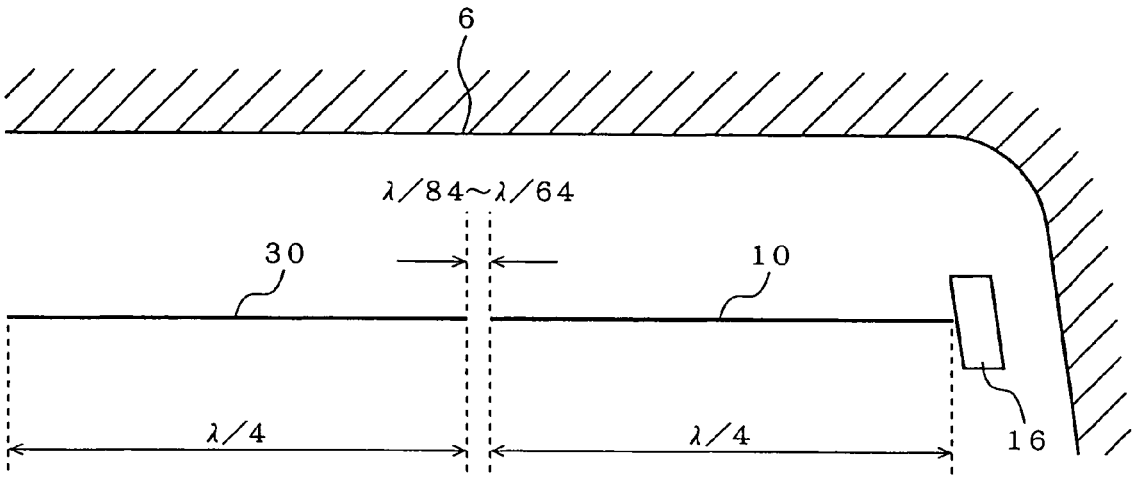
FIG. 19 shows an antenna pattern of a high frequency glass antenna of an embodiment 6.

FIG. 19 shows an antenna pattern of a high frequency glass antenna of an embodiment 6. This glass antenna comprises a parasitic line 30 having the length of (λ/4)κ positioned on the portion extended from of the feeding line 10. The distance in an extended direction between the feeding line 10 and the parasitic line 30 is in the range of (λ/84)κ-(λ/64)κ.

Figure 20:
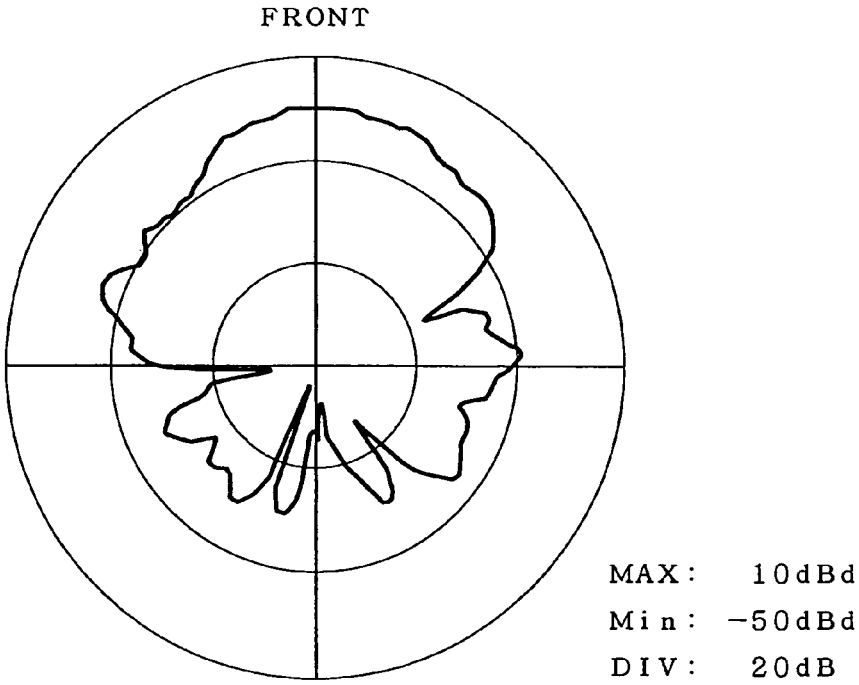
FIG. 20 shows a directivity of the antenna in the embodiment 6.

A directivity in a horizontal plane of this glass antenna was measured. The directivity shown in FIG. 20 was obtained. It is appreciated that the strong directivity in the forward direction of an automobile was realized.

The invention claimed is:

1. A glass antenna provided on the surface of a window of automobiles for transmitting/receiving a high frequency electric wave, comprising:

an antenna line positioned near to the metal portion of a body, one end of the antenna line neighbored to the metal portion being fed; and a parasitic line having first and second ends which are not connected, the parasitic line positioned near to the antenna line for adjusting a directivity and a frequency characteristic of reception sensitivity of the glass antenna, wherein a distance between the antenna line and the parasitic line is in the range of $(\lambda/84)\kappa$-$(\lambda/16)\kappa$, wherein $\lambda$ is a wavelength of a received wave in a high frequency band and $\kappa$ is a shortening factor.

2. The glass antenna according to claim 1, wherein the antenna line comprises at least one straight antenna line having the length of $(\lambda/4)\kappa$, the parasitic line is extended in parallel with the antenna line and comprises at least one straight conductor lines having the length in the range of $(\lambda/4)\kappa$-$(3\lambda/8)\kappa$, the length of each of the straight conductor lines being overlapped with the antenna line is in the range of $(\lambda/16)\kappa$-$(\lambda/16)\kappa$, and the distance between each of the straight conductor lines and the antenna line is in the range $(\lambda/84)\kappa$-$(\lambda/16)\kappa$.

3. The glass antenna according to claim 1, wherein the antenna line comprises a loop-shaped antenna line composed of two straight conductor lines extended in parallel with each having the length of $(\lambda/4)\kappa$, each of the two straight conductor lines having first and second ends, at least one of the first ends of the two straight conductor lines being connected to a feeding point, the second ends of the two straight conductor lines being connected to Each other, and the distance therebetween being in the range of $(\lambda/84)\kappa$-$(\lambda/16)\kappa$, the parasitic line comprises at least one straight conductor line extended in parallel with the loop-shaped antenna.

4. The glass antenna according to claim 1, wherein the antenna line comprises at least one straight antenna line having the length of $(\lambda/4)\kappa$, one end of the straight antenna line being connected to a feeding point, the parasitic line consists of two straight conductor lines extending in parallel with the antenna line and sandwiching a part thereof, the length of each of the two straight conductor lines being in the range of $(\lambda/4)\kappa$-$(\lambda/2)\kappa$, the length of the part of respective straight conductor lines overlapped with the antenna line is in the range of $(\lambda/16)\kappa$-$(\lambda/8)\kappa$, and the distance between each of the two straight conductor lines and the antenna line is in the range of $(\lambda/64)\kappa$-$(\lambda/16)\kappa$.

5. The glass antenna according to claim 1, wherein the antenna line comprises at least one straight antenna line having the length of $(\lambda/4)\kappa$, one end of the straight antenna line being connected to a feeding point, the parasitic line consists of two straight conductor lines extending in parallel with the antenna line and sandwiching a part thereof, the length of each of the two conductor lines being $(3\lambda/16)\kappa$, and a conductor line for connecting respective ends of the two straight conductor lines far from the feeding point, the length of the part of respective straight conductor lines overlapped with the antenna line is $(\lambda/8)\kappa$, and the distance between each of the two straight conductor lines and the antenna line is $(\lambda/64)\kappa$.

6. The glass antenna according to claim 1, wherein the antenna line comprises at least one straight antenna line having the length of $(\lambda/4)\kappa$, one end of the straight antenna line being connected to a feeding point, and the parasitic line consists of a straight conductor line positioned on the portion extended from the antenna line in a direction opposite to the feeding point, the length of the parasitic line being $(\lambda/4)\kappa$.

* * * * *